United States Patent [19]

Sambor

[11] Patent Number: 4,829,711

[45] Date of Patent: May 16, 1989

[54] LATERAL MOVEMENT ACTUATOR FOR LOWERABLE AUTOMOBILE WINDOW

[75] Inventor: Stephen P. Sambor, Southfield, Mich.

[73] Assignee: Ford Motor Company, Dearborn, Mich.

[21] Appl. No.: 248,052

[22] Filed: Sep. 23, 1988

[51] Int. Cl.[4] ..... E05F 11/52; E05F 11/48

[52] U.S. Cl. ..... 49/211; 49/352; 49/374

[58] Field of Search ..... 49/374, 375, 377, 348–353, 49/211

[56] References Cited

U.S. PATENT DOCUMENTS

| | | | |
|---|---|---|---|
| 1,085,877 | 2/1914 | Rheims et al. | 49/352 X |
| 1,610,272 | 12/1926 | Farewell | 49/350 X |
| 1,676,441 | 7/1928 | Jackson | 49/350 X |
| 4,730,414 | 3/1988 | Nakamura et al. | 49/374 X |
| 4,785,582 | 11/1988 | Tokue et al. | 49/374 X |

*Primary Examiner*—Philip C. Kannan

*Attorney, Agent, or Firm*—Daniel M. Stock; Clifford L. Sadler

[57] ABSTRACT

A window actuator assembly for a lowerable automobile window includes a molded plastic hub having short internal helical drive lugs drivingly engageable with helical grooves molded into external surfaces of a drive spindle to effect lateral outward movement of the lower edge of the window outwardly as it approaches its fully raised position, moved upwardly with the actuator assembly by a window regulator drive which is configured to rotate the spindle as it approaches the raised position. A hinged connection is provided between the hub and the window.

11 Claims, 5 Drawing Sheets

FIG. 2
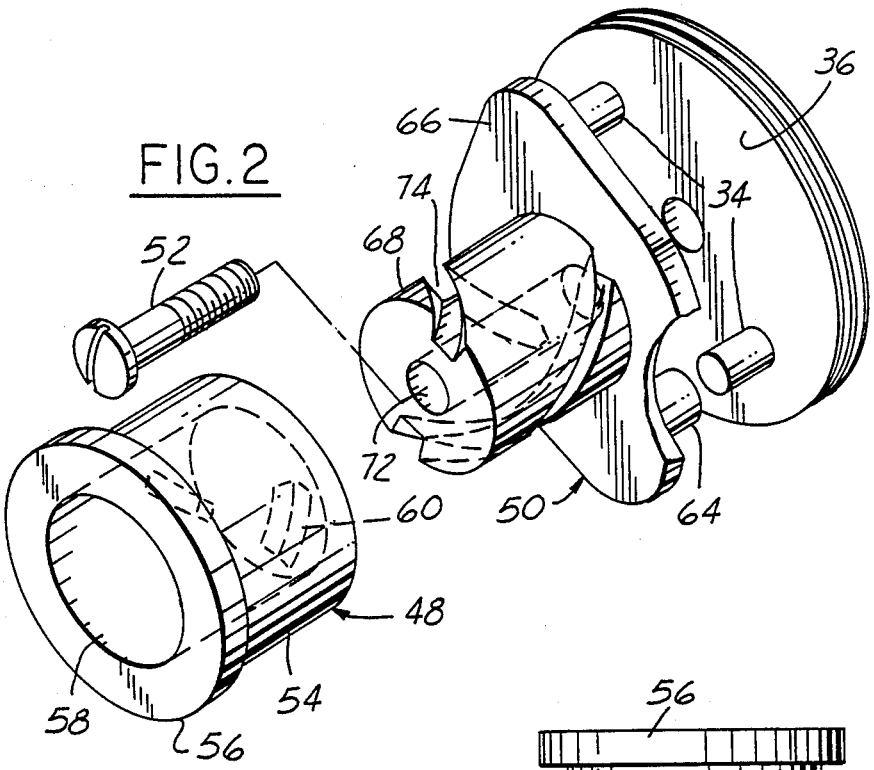
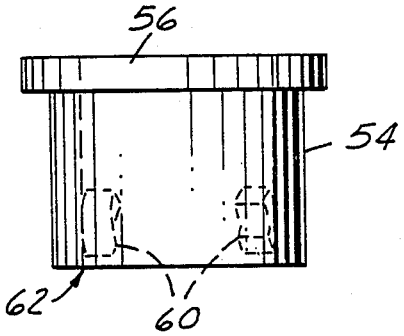
FIG. 3
FIG. 4
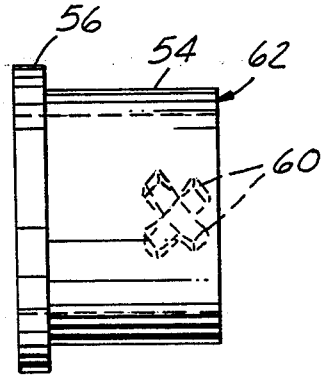
FIG. 5
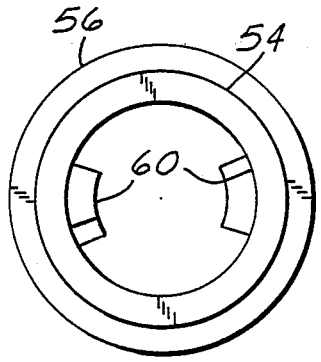

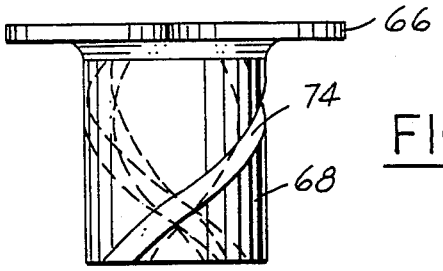
FIG.6
FIG.7
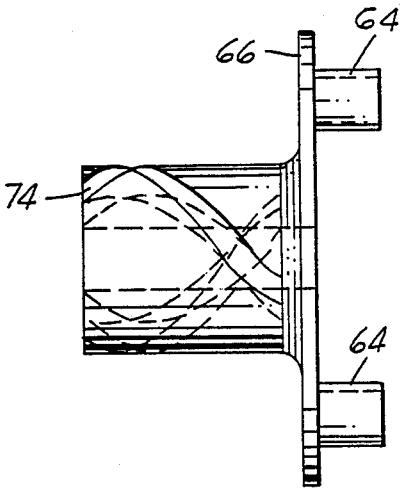
FIG.8
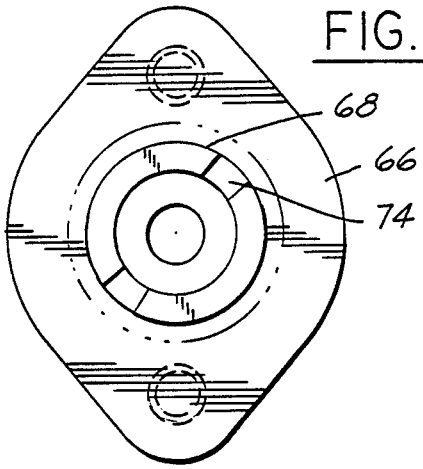
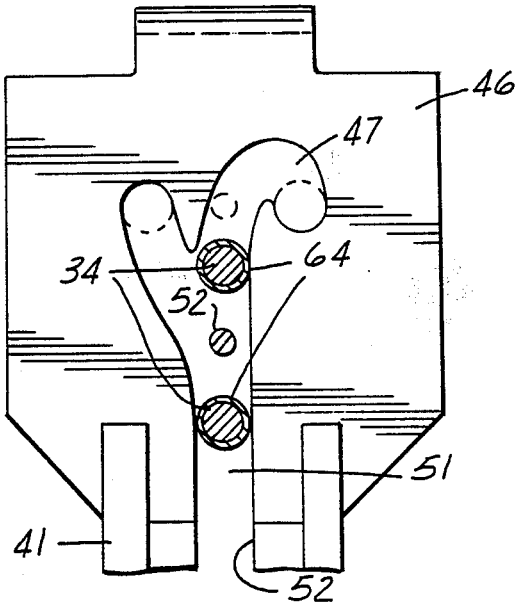
FIG.9

LATERAL MOVEMENT ACTUATOR FOR LOWERABLE AUTOMOBILE WINDOW

BACKGROUND OF THE INVENTION

The present invention relates generally to actuators and regulators of lowerable automobile windows and more specifically to actuators for effecting lateral movement of such windows.

DESCRIPTION OF THE PRIOR ART

The concentration of automotive designers upon aerodynamically efficient designs for automobiles has led to substantial interest and desire for automobile body constructions which provide for a flushness of the automobile windows with respect to the adjacent outer surfaces of the automobile body. Providing this flushness in the lowerable windows in the door of an automobile is a particularly challenging design task. Many models of automobiles, particularly those manufactured by the assignee of the present invention, display an offset of only a few millimeters between the outer surface of most of the glass and the adjacent body parts. A more substantial offset has been necessary, however, at the lower edge of the window, the belt line of the automobile because the windows generally move in a continuous straight or curvilinear path from a position well within the body.

One approach being actively considered to achieve belt line flushness is to provide some mechanism for shifting the lower edge of the glass laterally with respect to the automobile's body as the window approaches its raised position. No suitable actuators are known in the prior art relevant to actuators and regulators mechanisms for lowerable automobile windows. Even though certain prior art devices which provide for the lateral shifting of window elevating handles in automobile doors, such as those exemplified in U.S. Pat. Nos. 1,610,272 to Farwell and 1,676,441 to Jackson are known, none have shown any effective operative connection to the window itself.

U.S. Pat. No. 1,085,877 to Rheims et al provided a very early showing of a mechanism for effecting lateral movement to the lower edge of the window upon rotation of the handle used for raising the window. It was significantly defective in its teachings, however. Among the disadvantages of the Rheims et al apparatus is the fact that its use requires that the raising path of the window or its actuator be changed during its laterally outward shifting because of the rigid connection provided between the window and the apparatus of Rheims et al and the apparatus. Further, the Rheims et al apparatus effects a driving interconnection between window and actuator through a spurred plate engaging a guideway. The stability of the motion effected by such an interconnection is less than desirable as is its reliability and manufacturability.

SUMMARY OF THE INVENTION

Responsive to the deficiencies in the prior art, it is an object of the present invention to provide an actuator assembly for moving the lower edge of the lowerable automobile window laterally with respect to the body that provides for connection with the window configured to permit movement of the window within the path in which it is guided within the vehicle body.

According to another feature, it is another object of the present invention to provide an actuator assembly for moving the lower edge of the lowerable automobile window laterally with respect to the automobile body in which the actuator includes a stable, reliable, economically producible driving interconnection for converting rotative motion into the desired lateral motion.

According to a feature of the present invention, an actuator assembly is provided which includes a hub member shiftable laterally with respect to the body and hingedly connected to the lower edge of the automobile window.

According to another feature of the present invention, an actuator assembly is provided which includes a hub member drivingly connected to a spindle member to effect lateral displacement of the hub member upon rotation of the spindle member and the hub member and the spindle member are drivingly interconnected through a plurality of helically extending lugs formed within a bore of the hub member and a plurality of helically extending grooves formed on the outer surface of the spindle member for effecting the driving engagement.

BRIEF DESCRIPTION OF THE DRAWINGS

These and other objects and features will be apparent to those skilled in the automotive arts upon reading the following description with reference to the accompanying drawings in which:

FIG. 2 is an exploded perspective view of the actuator assembly of the present invention separated from the lowerable window assembly;

FIGS. 3 and 4 are side views of the hub of the actuator of the present invention;

FIG. 5 is an end view of the hub;

FIGS. 6 and 7 are side views of the spindle of the actuator of the present invention;

FIG. 8 is an end view of the spindle;

FIG. 9 is a partial plan view of a driving cam portion of a window regulator suitable for use with the actuator assembly of the present invention;

DESCRIPTION OF THE PREFERRED EMBODIMENT

Figure 1:
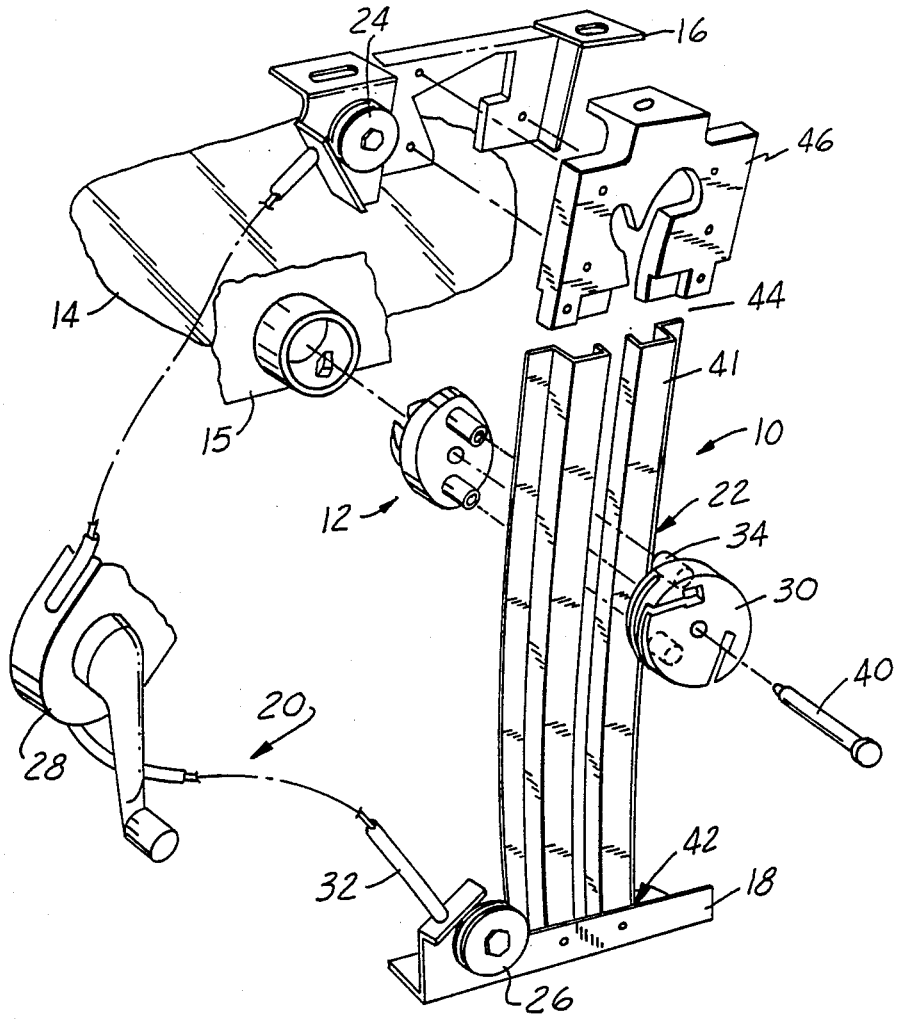
FIG. 1 is an exploded perspective view of a lowerable automobile window assembly incorporating the actuator assembly of the present invention.

Turning now to the drawings and particularly to FIG. 1 thereof, a window regulator assembly 10 incorporating the window actuator assembly 12 of the present invention is illustrated in an exploded view with the components of the assemblies generally arrayed as they would be when the window regulator assembly 10 is assembled into an automobile door (not shown) for raising and lowering a window shown in part at 14 through a support plate 15.

In addition to the window actuator assembly 12 of the present invention, the window regulator assembly 10 includes an upper body mounting plate 16, a lower body mounting plate 18, a drive assembly indicated generally at 20 and a guide assembly 22. Upper and lower body mounting plates 16 and 18 are fixed within the automobile door proximate the belt line and sill, respectively, and include suitable mounting structure for carrying the drive assembly 20 and the guide assembly 22.

The drive assembly 20 is illustrated as including an upper pulley 24 rotatably mounted on the upper body mounting plate 16, a lower pulley 26 rotatably mounted on the lower body mounting plate 18, a cranking pulley, indicated as a handle assembly at 28, conventionally mounted on the automobile door, and a driver member 30, all interconnected by cables, partially shown and indicated by the numeral 32. The wrapping of the cable 32 about the pulleys 24, 26, the handle 28 and driver 30, is not illustrated since their interconnection forms no part of the present invention. As the description progresses, it will be clear that any window lifting mechanism that effects vertical movement of the window actuator assembly 12 as it moves from the lowered position toward the raised position of the window, followed by rotative motion of the window actuator assembly 12 as it moves vertically proximate the raised position may be accommodated. The drive member 30 in the embodiment illustrated in FIG. 1 is a pulley member, drivingly engageable with the cable 32, which as may best be seen in FIG. 2 includes a pair of diametrically opposed drive lugs 34 extending perpendicularly from its inner face 36. A central aperture 38 is provided for receiving a conventional fastener 40 providing axial interconnection between the drive member 30 and the window actuator assembly 12.

The guide assembly 22 comprises a pair of spaced curvilinearly extending guide rails 41 secured at their bottoms 42 to the lower body mounting plate 18 and at their tops 44 an actuator plate 46, which is in turn secured to the upper body mounting plate 16. The actuator plate 46, as may best be seen in FIG. 9, includes a generally Y-shaped through aperture 47 which has a base portion 51 registering with the slot 52 formed between the spaced guide plates 41. As may best be appreciated by reference to FIGS. 1, 9 and 10, the drive lugs 34 of the drive member 30 are aligned to slide within the slot 52 as the window 14 is raised and as the window 14 approaches its fully raised position, the lugs 34 enter the Y-shaped aperture 47 and further upward movement effects rotation of the drive member 30 as the diametrically spaced lugs 34 follow the contour of the Y-shaped aperture 47 from tee solid line position of FIG. 9 to the dotted line position.

Turning now. to FIGS. 2–7, the window actuator assembly 12 is illustrated as comprising a hub member 48 and a spindle member 50 drivingly engaged with the hub member 48 and with the drive member 30 of drive assembly 20. Axial retention of the window actuator 12 with respect to the drive member 30 is accomplished through insertion of a fastener 52 into the spindle member 50 for engagement with the threaded fastener 40.

The hub member 48 is formed preferably of plastic byrough molding as a generally cylindrically part having a barrel portion 54 having a mounting flange 56 at one end and a central through bore 58. Extending radially inwardly with respect to the through bore 58 are a pair of helically extending lugs 60, the lugs 60 are positioned axially near the end 62 of the barrel portion 54 remote from the mounting flange 56. The lugs 60 extend axially substantially less than the length of the barrel portion 54 and are arranged in diametrically opposed circumferential relationship. It is preferable that the lugs 60 be fabricated integrally with the remainder of the hub member 48 and the length and position of the lugs is preferably specified with a view to that integral manufacture. Separate lugs may be secured to a hub member to duplicate the desired function, however.

The spindle member 50 is also preferably formed as a unitary molded plastic part and is illustrated as comprising a pair of diametrically opposed drive receptacles 64 for receiving drive lugs 34 of drive member 30, a drive flange 66 and a hub driving portion 68. The receptacles 64 are configured to provide a driving connection between the drive member 30 and the spindle member 50, as indicated at 70 in FIG. 11. A central through aperture 72 is forced through the spindle member 50 for receiving the axially retaining fastener 52, as may best be seen in FIG. 2. The hub driving portion 68 is formed as a cylinder extending perpendicularly from the flange portion 66 and it includes a pair of diametrically opposed helically extending grooves 74 formed on its outer periphery and extending axially from end to end of the hub driving portion 68. The cross-section of the grooves 74 is configured to slidingly engage the lugs 60 of hub member 48. Upon engagement of the lugs 60 within the grooves 74, rotation of the spindle member 50 produces a force axially driving the hub member through the interconnection between the grooves 74 and the lug 60. The short length of the lugs 60 with respect to the grooves 74 facilitates the travel of the hub member 48 with respect to the spindle member 50 and allows for accommodation of manufacturing tolerances in the fabrication of the parts themselves as well as their position within the window regulator system in an automobile body. The diametrically spaced positioning of the points of driving engagement between the hub member 48 and the spindle member 50 enhances the stability of these relatively moving parts during movement and at all the relative positions.

OPERATION OF THE PREFERRED EMBODIMENT

Figure 10:
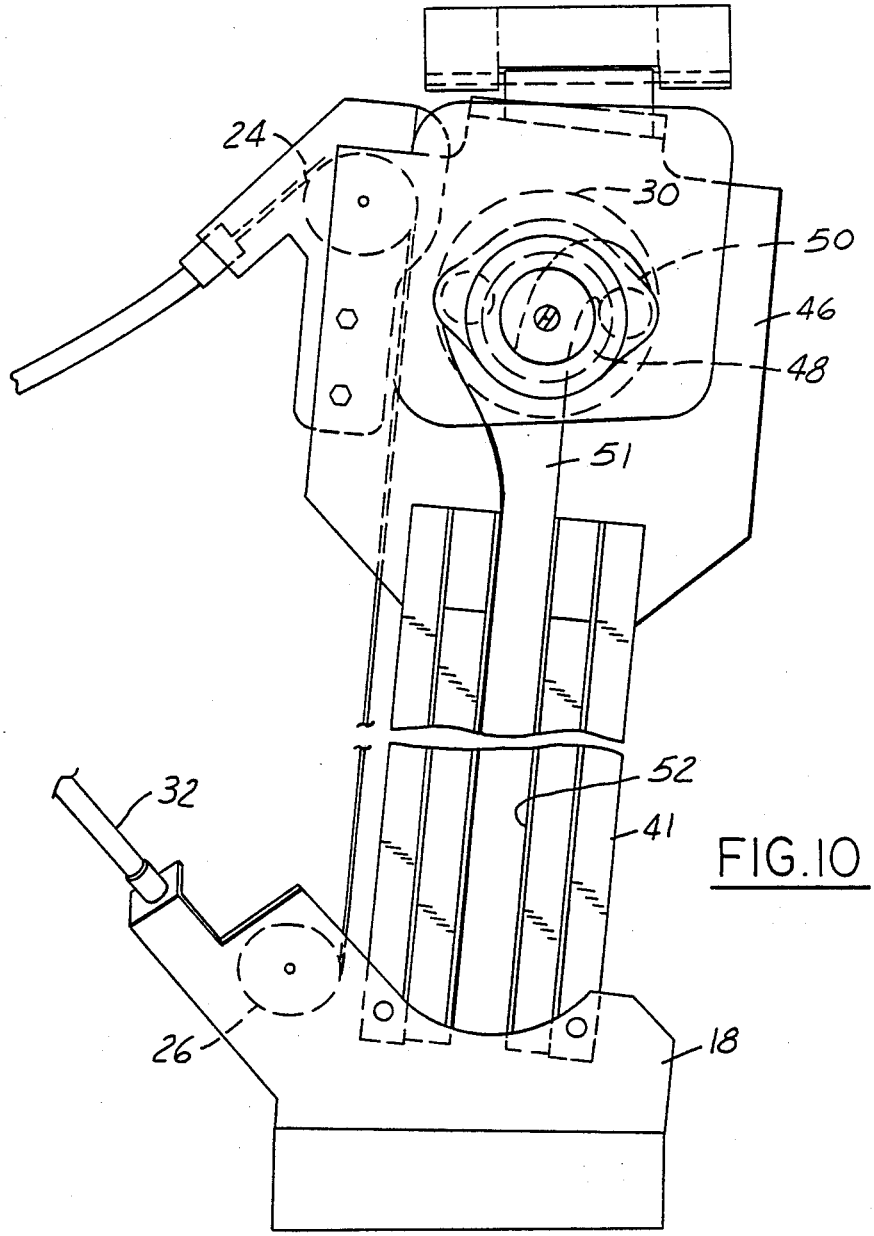
FIG. 10 is a front view of window regulator system employing the actuator assembly of the invention.
Figure 11:
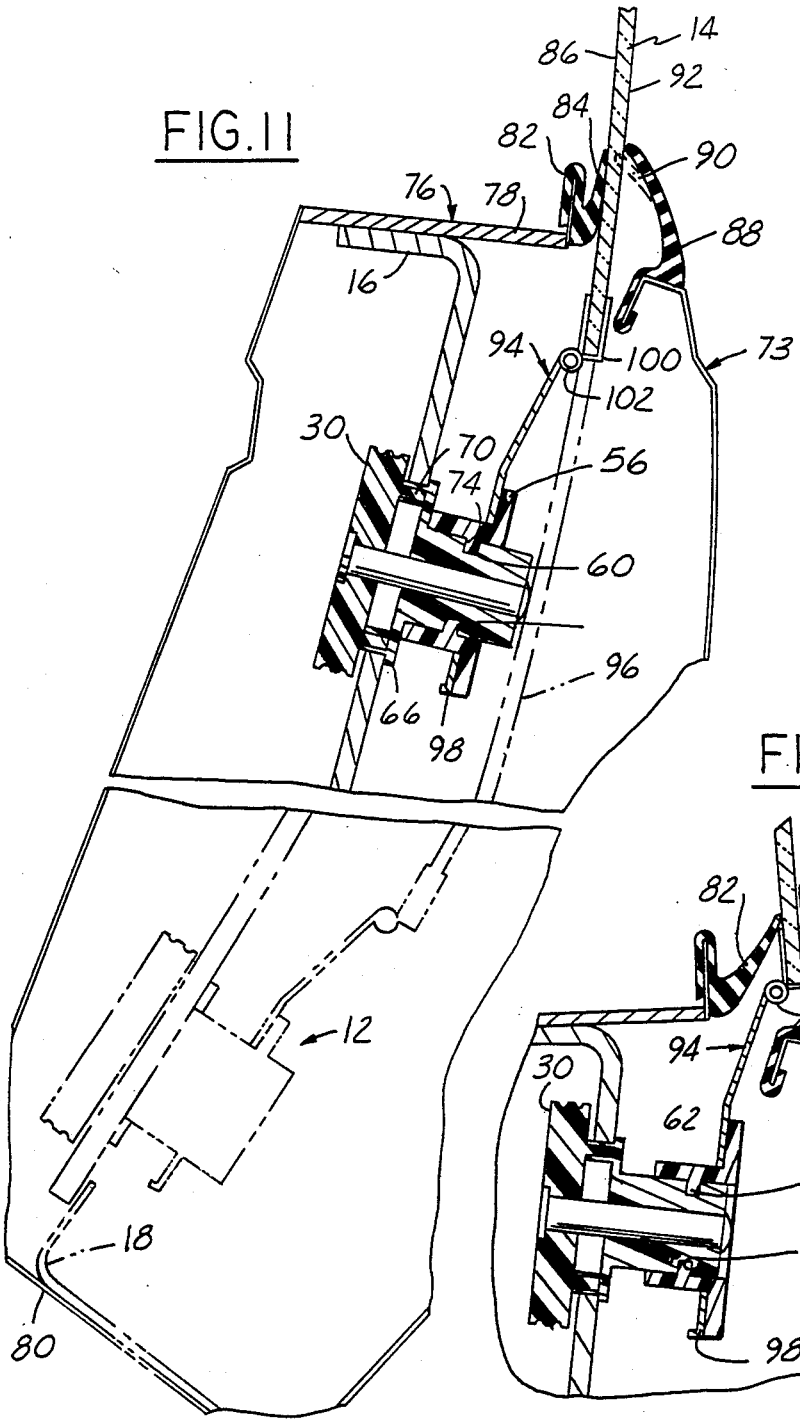
FIG. 11 is a cross-sectional view through a vehicle door illustrating the actuator assembly as it is positioned with the window fully lowered and partially raised.
Figure 12:
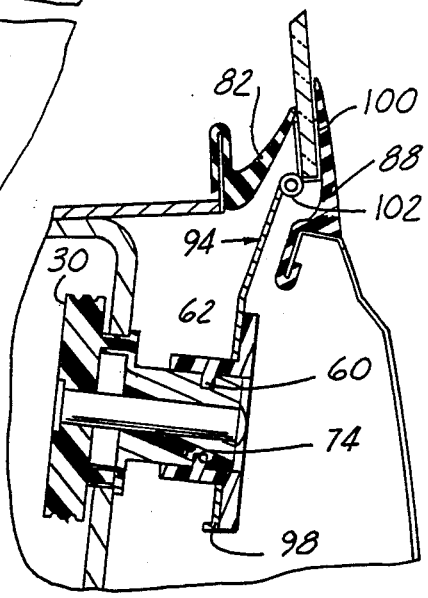
FIG. 12 is a cross-sectional view similar to FIG. 11 wherein the window is fully raised.

Turning now to FIGS. 10–12, the operation of the window actuator assembly 12 of the present invention to effect lateral movement of an automobile window 14 between positions inwardly displaced from the outer surface of an automobile body and a flush position will best be appreciated. In FIGS. 11 and 12, the window actuator assembly 12 is illustrated as it is installed in an automobile door indicated generally at 73. The door 73 includes an outer panel 74 which defines the decorative outer surface of the automobile and an inner panel 76. An upper portion 78 of the inner panel 76 is fixedly secured to the upper body mounting plate 16 and a lower portion 80 is similarly secured to the lower body mounting plate 18. Also carried on the inner door panel 76 is an inner seal 82 having a lip portion 84 for engaging the inner surface 86 of the window 14. Similarly, an outer seal 88 having a lip portion 90 engages the outer surface 92 of the window 14.

It will also be noted that in the showings of FIGS. 10–12, attachment of the window 14 to the invention window actuator assembly 12 is effected through a hinged plate 94. As an alternative to the fixed connection provided by the plate 15 illustrated in FIG. 1, this pivotally free connection is desirable for accommodating differences in the path of movement of the window actuator assembly 12 as constrained by the guide assembly 22 and the movement of the window 14 as constrained by conventional sealing channels as indicated as curvilinearly extending at 96 in FIG. 11. The hinged plate member 94 consists of a mounting plate portion 98 fixedly secured as through adhesives to the hub member 48 proximate its mounting flange portion 56. A channel portion 100 grippingly receives the lower edge of the window 14 and is pivotally connected to the mounting plate portion 98 as through a hinge indicated at 102 in FIGS. 11 and 12.

In the lower portion of FIG. 11, the window actuator assembly 12 is indicated in its lowered position. Turning the crank 28 of the drive assembly 20 draws the window actuator assembly 12 curvilinearly upwardly along the guide rails 41 with projections 34 within receptacles 64 slidingly engaged within the slot 52. The spindle member 50 and the hub member 48 retain their assembled positions during this stage of the travel, that is, the position shown in cross-section in FIG. 11 in which tee inner end 62 of hub member 48 is positioned proximate the flange portion 66 of the spindle member 50.

Wherein this partially raised position, the lower edge of the window 14 is spaced inwardly from the outer panel 74 of the door 73. Further upward movement results in the projections 34 within the receptacles 68 entering the Y-shaped plate 46 and the configuration of the Y aperture 47 effects turning of the spindle assembly as indicated to the position indicated by dotted lines in FIG. 9. As the spindle member 50 is turned, the driving interconnection between the grooves 4 of the spindle member 50 and the lugs 60 of the hub member 48 results in axial lateral outward displacement of the hub member 48 to the position shown in FIG. 12 in which the window 14 is in a position approximately flush with the outer panel 74 of the door 73. The matching of the outer curvature of the window 14 to that of the outer panel 74 is accommodated by the configuration of the guide channels 96 and the provision of the hinged plate 94 reduces the degree of precision necessary to duplicate this flushness producing curvature in the guide rails 41 controlling the path of the window actuator assembly 12. Reversal of motion of the drive assembly 20 results in reverse rotation of the spindle member 50 and withdrawal of the hub member 48 from the axially laterally outward position of FIG. 12 to the position of FIG. 11 for dropping the window 14 into the door 73.

While only certain embodiments of the actuator assembly of the present invention have been described, others may be possible without departing from the scope of the appended claims.

I claim:

1. In a window regulator assembly for a window of an automobile body vertically movable between lowered and raised positions, an actuator assembly for moving the lower edge of the window laterally with respect to the body when the window is moved to its raised position, the actuator assembly comprising:

a hub member;

means for moving the hub member vertically between positions corresponding to the raised and lowered positions of the window and for shifting the hub member laterally with respect to the body during vertical movement proximate the raised position;

a support member fixedly secured to the window proximate the lower edge thereof; and hinge means operatively connected between the hub member and the support member for permitting pivotal movement therebetween.

2. An actuator assembly as defined in claim 1 wherein:

the support member comprises a channel member grippingly secured to the window lower edge; and the hinge means comprises:

a first plate member fixedly secured to the channel member;

a second plate member fixedly secured to the hub member; and means for pivotally connecting the first plate member to the second plate member.

3. In a window regulator assembly for a window of an automobile body vertically movable between lowered and raised positions, an actuator assembly for moving the lower edge of the window laterally with respect to the body when the window is moved to its raised position, the actuator assembly comprising:

a hub member including a housing having a bore formed therein and having a plurality of helically extending lugs projecting radially inwardly with respect to the bore;

means for operatively connecting the hub member to the window;

a spindle member having a cylindrical hub driving portion including a plurality of helically extending grooves formed therein for drivingly receiving the hub member lugs whereby rotation of the spindle member effects axial displacement of the hub member; and means for moving the spindle member vertically between positions corresponding to the raised and lowered positions of the window and for rotating the spindle member to effect displacement of the hub member during vertical movement proximate the raised position.

4. An actuator assembly as defined in claim 3 wherein the lugs are formed integrally with the hub member.

5. An actuator assembly as defined in claim 3 wherein the hub member comprises a molded plastic part having the lugs integrally formed therewith.

6. In a window regulator assembly for a window of an automobile body vertically movable between lowered and raised positions, an actuator assembly for moving the lower edge of the window laterally with respect to the body when the window is moved to its raised position, the actuator assembly comprising:

a hub member, including a housing, having a bore formed therein and having a plurality of helically extending lugs projecting radially inwardly with respect to the bore;

a support member fixedly secured to the window proximate the lower edge thereof;

hinge means operatively connected between the hub member and the support member for permitting pivotal movement therebetween;

a spindle member having a cylindrical hub driving portion including a plurality of helically extending grooves formed therein for drivingly receiving the hub member lugs whereby rotation of the spindle member effects axial displacement of the hub member; and means for moving the spindle member vertically between positions corresponding to the raised and lowered positions of the window and for rotating the spindle member to effect displacement of the hub member during vertical movement proximate the raised position.

7. An actuator assembly as defined in claim 6 wherein the lugs are formed integrally with the hub member.

8. An actuator assembly as defined in claim 6 wherein:

the support member comprises a channel member grippingly secured to the window lower edge; and the hinge means comprises:

a first plate member fixedly secured to the channel member;

a second plate member fixedly secured to the hub member; and means for pivotally connecting the first plate member to the second plate member.

9. An actuator assembly as defined in claim 6 wherein:

the support member comprises a channel member grippingly secured to the window lower edge; and the hinge means comprises:

a first plate member fixedly secured to the channel member;

a second plate member fixedly secured to the hub member in surrounding relationship with respect to the hub member housing ; and means for pivotally connecting the first plate member to the second plate member.

10. An actuator assembly as defined in claim 6 wherein the hub member comprises a molded plastic part having the lugs integrally formed therewith.

11. An actuator assembly as defined in claim 10 wherein: the support member comprises a channel member grippingly secured to the window lower edge; and the hinge means comprises:

a first plate member fixedly secured to the channel member;

a second plate member fixedly secured to the hub member; and means for pivotally connecting the first plate member to the second plate member.

* * * * *